United States Patent [19]

Kauf et al.

[11] 4,116,149

[45] Sep. 26, 1978

[54] CENTRIFUGAL BLADE FOR A TURBINE - ROTOR METHOD FOR MAKING THE SAME

[75] Inventors: Alois Kauf, Unterzeitlbach; Georg Kandler, Unterpfaffenhofen; Axel Rossmann; Fritz Nustede, both of Karlsfeld, all of Germany

[73] Assignee: Motoren- und Turbinen-Union Munchen GmbH, Munich, Germany

[21] Appl. No.: 753,110

[22] Filed: Dec. 21, 1976

[30] Foreign Application Priority Data

Dec. 23, 1975 [DE] Fed. Rep. of Germany ..... 2558436

[51] Int. Cl.[2] ..... B21D 51/00

[52] U.S. Cl. ..... 113/116 D; 29/156.8 B; 72/200; 72/342; 72/379

[58] Field of Search ..... 416/219; 113/116 D; 29/156.8 B, 156.8 C, 156.8 F; 72/200, 201, 203, 206, 342, 364, 377, 379, 365

[56] References Cited

U.S. PATENT DOCUMENTS

| | | | |
|---|---|---|---|
| 2,638,663 | 5/1953 | Bartlett et al. | 29/156.8 B |
| 2,848,190 | 8/1958 | Barr | 416/219 X |
| 2,959,843 | 11/1960 | Vitvlugt | 29/156.8 B |
| 3,002,264 | 10/1961 | Hollis et al. | 29/156.8 |
| 3,314,137 | 4/1967 | Schellens | 29/413 |
| 3,458,119 | 7/1969 | Shaw | 416/216 |
| 3,762,835 | 10/1973 | Carlson et al. | 29/156.8 B |

OTHER PUBLICATIONS

"Extruded Blades," *Product Engineering*, Nov. 1948, p. 246.

*Primary Examiner*—Leon Gilden
*Attorney, Agent, or Firm*—Haseltine, Lake & Waters

[57] ABSTRACT

A T-root, centrifugal turbine rotor blade which is manufactured from sheet stock. The T-root is produced by shaping the rim of the sheet stock under pressure. The sheet stock is given a rim contour which is geometrically similar to the final contour of the blade root, but is larger by a seam which is shaped under pressure for forming a T-shape having the rim contour of the blade root. After the sheet rim is shaped, a plurality of blades are cut or stamped from the sheet stock. The latter may be in annular form, and may possess various curvatures over its circumference. The sheet stock may be curved three-dimensionally before the T-rim produced.

13 Claims, 6 Drawing Figures

CENTRIFUGAL BLADE FOR A TURBINE - ROTOR METHOD FOR MAKING THE SAME

BACKGROUND OF THE INVENTION

This invention relates to a T-root, centrifugal turbine rotor blade manufactured from sheet stock and to a method for its manufacture.

The manufacture of centrifugal turbine rotor blades in sheet construction has long been attempted. These blades have not matured for series production, however, at least not for use on high-speed rotors, because it was impossible to safely attach them on the hub. The connection of the blade to the hub requires a high-strength material and, moreover, optimum transfer of forces, i.e., a design minimizing stress concentrations. This could not be achieved, however, with the conventional welding and brazing methods. The practice was, e.g., to join blades to the hub by their unmodified front edge, when welding caused unacceptable undercutting and/or notching in the weld transition. The practice of bending the end of the blade into L-shape and of joining the L-leg, which extended in parallel with the hub, to the hub occasioned, under high centrifugal loads, bending moments which in turn caused the brazed or welded joint to separate. The same was bound to happen when the bent L-end of the blade was additionally fitted with a sheet angle to form a T-root. The inevitable outer radii of the L-bends again produced bending moments and separating loads on the joint.

In a broad aspect, the present invention provides a centrifugal blade made from sheet stock for safe connection to the rotor hub also under extremely high loads.

It is a particular object of the present invention to provide a centrifugal blade of the above generic category where the T-root of the blade is formed by shaping the rim of the sheet stock under pressure.

This gives a flat blade root suitable for joining to the rotor hub by brazing, welding or also explosive welding in that it offers a wide cross-section for connection without stress raisers.

Another object of the present invention is to provide a centrifugal blade for the foregoing character which may be economically fabricated and which has a substantially long operating life.

SUMMARY OF THE INVENTION

The objects of the present invention are achieved by providing an arrangement for manufacturing the centrifugal blade with the feature that the rim contour of the sheet stock is geometrically similar to the final contour of the blade root but is extended by the length of a hem which is then shaped to form a T having the edge contour of the blade root. The method of this invention not only provides a blade root contour ideally suited for connection to a rotor hub but it also gives, by shaping the root under pressure, optimum grain flow in the blade material and, thus, maximum strength of the blade proper.

In a further feature of this invention the edge of the sheet stock is first shaped to form a T, and several blades are then cut or blanked from one piece of sheet stock. This method makes for economical manufacture of centrifugal blades, which are normally used in large quantities. This assumes, of course, that the contour of the sheet rim is such as is formed by the roots of several blades placed side by side or one behind the other.

Since the rotor hub on which the centrifugal blades are to be attached are in most cases sections from a circular torus, it is a further provision of this invention that the sheet stock is circular in shape. Such sheet stock lends itself most readily for producing a T-shape having a likewise circular rim contour, so that as many centrifugal blades can be cut or blanked from the sheet stock with the T-contour as blade roots will fit lengthwise into the circumference of the sheet stock.

In a further feature of the present invention, use is made of sheet stock exhibiting various curvatures over its circumference when it is intended to manufacture blades the root curvature of which is not consistent, i.e., which are not intended for attachment to a rotor hub forming part of a circular torus. In this manner it will be possible to cut a plurality of blades from a piece of sheet stock also if the root curvature of these blades is not consistent.

Since three-dimensionally curved blades are preferred for their better efficiency over blades bent in one direction only, it is a further feature of the present invention that the sheet stock is bent three-dimensionally before the T is shaped into the rim, to cut finished, three-dimensionally curved centrifugal blades from the sheet stock.

In a further aspect of the present invention, the width of the T-profile is about six times the thickness of sheet stock. This width is adequate for connection to the hub but still does not require considerable manufacturing effort as regards the degree of forming that is needed.

In a further aspect of the present invention an especially uniform T-shape is achieved if shaping is done by rolling. It has been shown that in this method of forming a few revolutions will be sufficient to give the projecting hem of the sheet stock a T-shape, if the forming roller is fed in a direction vertical to the axis of rotation.

Since hot rolling is generally the only acceptable shaping method for high-strength materials such as are used for turbine blades, it is a further feature of the present invention that the hem of the sheet stock is heated to rolling temperature by passing electrical current through it. This electrical method of heating provides an advantage in that the heating can be very accurately controlled locally and in that contamination or dirt in the heating areas are prevented. This is an important consideration with turbine blades because rework is allowed to only a very limited extent, and because the surface finish and cleanness requirements in turbine construction are especially stringent.

In a further feature of the present invention, the sheet stock is clamped for shaping the rim in dies having a contour which corresponds to the intended contour of the sheet rim and having edges which are rounded using a radius approximately equal to the thickness of sheet. By clamping the sheet stock between special-shaped dies the intended contour of the sheet rim can be rolled in a single working operation, or in one clamping operation.

In a further embodiment of the present invention, the dies simultaneously serve as electrodes to carry the heating current. This provides an advantage in that the high clamping pressures needed to shape the sheet stock make for good transfer of electrical current between the dies and the sheet stock. The electrical current, moreover, is supplied in the immediate vicinity of the shaping areas of the material when the current is supplied through the dies.

In a further embodiment of the present invention, the dies are simultaneously cooled for dissipation of the heat caused by heat conductivity from the heated sheet hem and by the passage of electrical current, so that the strength of the dies is not impaired.

In a further feature of the present invention the dies are made from a tungsten-copper alloy having a tungsten content of about 85% and a copper content of about 15% for high heat resistance of the dies.

In a further feature of this invention the working roller also serves as the second electrode to carry the heating current. This provides an advantage in that the high pressure with which the roller bears down on the edge of the sheet stock makes for good transfer of current between the electrode and the work. The roller, again, is cooled so as not to jeopardize its strength in any way.

In a further embodiment of this invention the speed of the sheet stock clamped between the dies and the speed of the roller are adjustable separately.

In a final feature of the present invention, the method is used to process sheet stock of preferably high-strength material, such as titanium-copper alloy, or titanium-aluminium alloy or nickel basis alloy comprising 25–60% Ni or such as a martensitic steel i.e., such materials as are used for highstrength turbine blades and as cannot conventionally be given the shape required for turbine blades.

The novel features which are considered as characteristic for the invention as set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
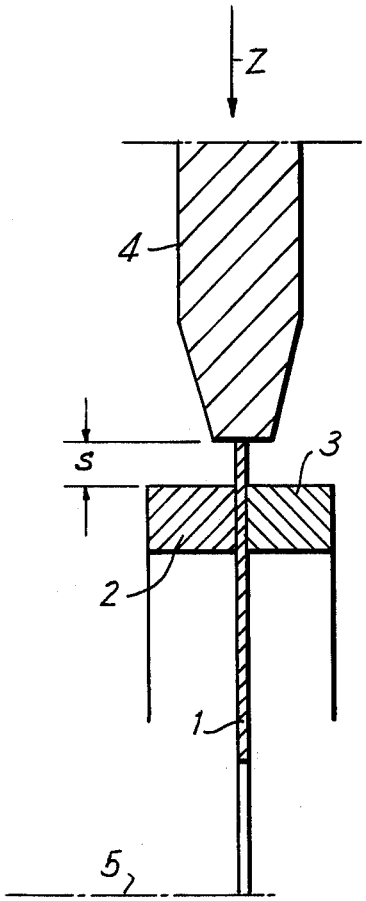
FIG. 1 is a sectional elevational view and illustrates sheet stock clamped between dies before shaping under pressure.

With reference now to FIG. 1, the numeral 1 indicates flat sheet stock clamped between two annular dies 2, 3 such that a hem of dimension *s* is allowed to project beyond the dies 2, 3. The radius of the dies 2, 3 at their outer edges abutting on sheet stock 1 is approximately equal to the thickness of sheet stock. A roller 4 has a feed direction Z which is precisely vertical to the axis of rotation 5 of the dies 2, 3 and is positioned to just touch sheet stock 1 at the outer edge of the hem *s*.

Figure 2:
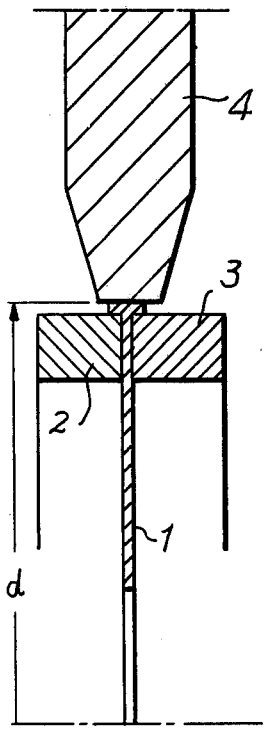
FIG. 2 is a sectional elevational view and illustrates the sheet stock in the sample clamping arrangement upon completion of the rolling process.

In FIG. 2 the hem *s* of sheet stock 1 has already been shaped to form a T. The outer diameter of the now T-rimmed sheet stock 1 is indicated by the alphabetical character *d*. In shaping, the sheet stock 1 clamped between the dies 2, 3 revolves about the axis of rotation 5, with the roller 4 turning simultaneously and being fed in the direction of the axis of rotation 5.

Figure 3:
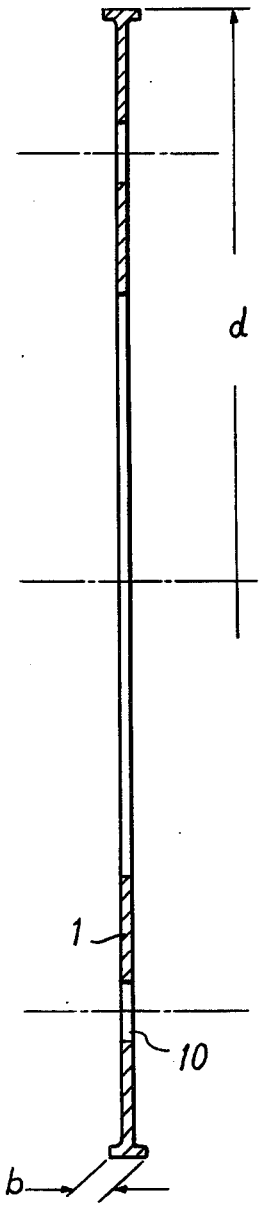
FIG. 3 is a sectional view and illustrates flat sheet stock with rim which has already been given T-shape.

FIG. 3 is a sectional view of a whole piece of sheet stock again indicated by the numeral 1. This is flat sheet stock in accordance with FIGS. 1 and 2, with the rim already T-shaped. The width *b* of the T-rim is about 6 times the thickness of the sheet thickness. As previously indicated in FIGS. 1 and 2, the sheet 1 is annular, with several holes provided in the ring to accommodate tiebolts to clamp dies 2, 3 together with the aid of clamping means not shown on the drawing.

Figure 4:
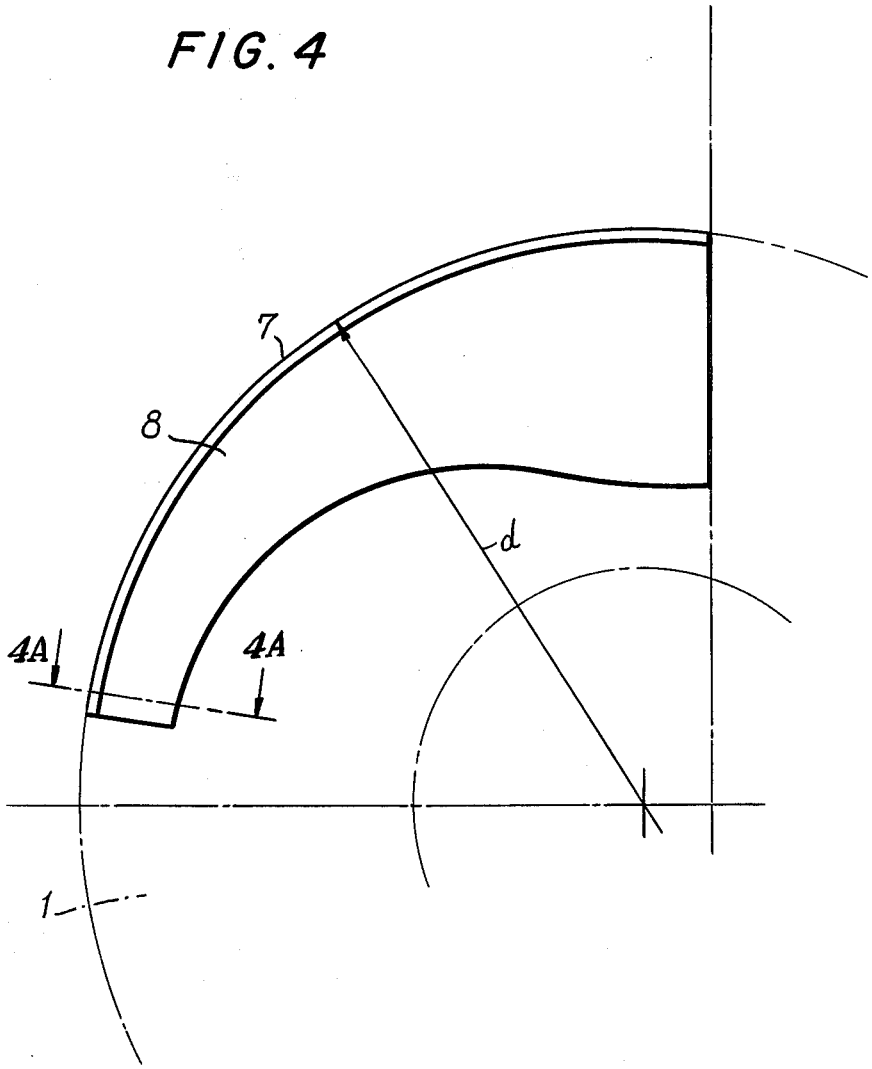
FIG. 4 is a top view and illustrates a centrifugal turbine blades sectioned from T-rim sheet stock.
Figure 4A:
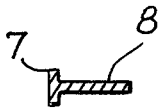
FIG. 4*a* is a sectional view taken along line 4A—4A in FIG. 4.

FIG. 4 is a top view of a centrifugal blade 8 cut from shaped sheet. The T-shaped blade root 7 has a rim contour corresponding to a circle segment, and the dash-dotted line shows the contour of sheet 1 from which the centrifugal blade 8 was cut. As will be seen from this representation, several blades 8 may be cut or blanked from one piece of sheet 1.

Figure 5:
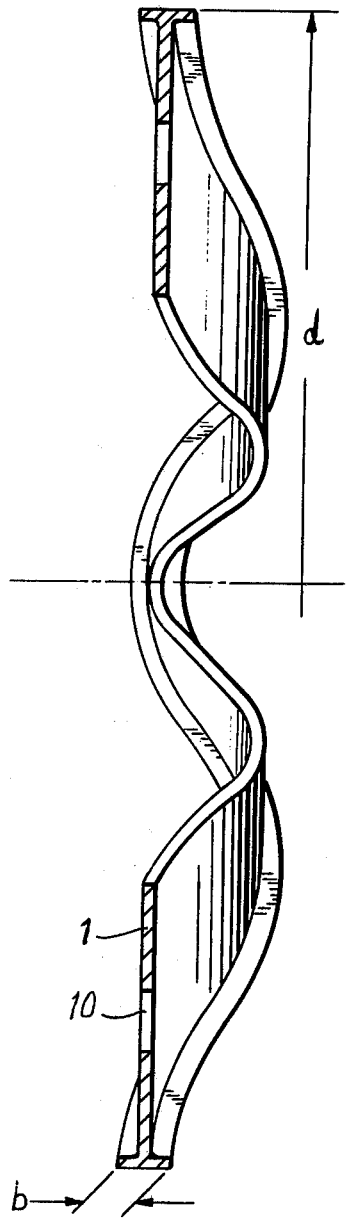
FIG. 5 is a sectional view and illustrates threedimensionally curved sheet stock with a T-rim.

The three-dimensionally curved sheet in FIG. 5 is again indicated by the numeral 1. The width *b* of the T-rim of this sheet is about 6 times the thickness of a sheet in the case with the flat sheet according to FIGS. 1 and 2. In the manufacture of the three-dimensionally curved sheet of FIG. 5, the three-dimensional curvature is incorporated before the rim is shaped to form a T, i.e., when the sheet is clamped between the dies it already has the three-dimensionally curved shape and the dies go through a shuttle movement when the rim is rolled to form the T-shape.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention, and therefore, such adaptations should and are intended to be comprehended within the meaning and range of equivalents of the following claims.

What is claimed is:

1. A method for producing turbine rotor blades having curved root portions by using sheet stock comprising of steps of: applying to sheet stock an outer rim curvature geometrically similar to a final curvature of the root portions of said blades; curving said sheet stock three-dimensionally; clamping said sheet stock in dies having a circumferential contour corresponding to the final contour of the root portions of said blades but being smaller for forming a seam; rolling said seam under pressure for forming a T-shape having a final rim curvature of the root portions of said blades; and cutting a plurality of blades from said sheet stock.

2. A method as defined in claim 1 wherein the outer curvature is of circular shape.

3. A method as defined in claim 1 wherein the width of the T-rim is substantially six times the thickness of said sheet stock.

4. A method as defined in claim 1 including the step of heating said seam to rolling temperature by passing electrical current therethrough.

5. A method as defined in claim 1 including the step of applying heating current to said dies.

6. A method as defined in claim 5 including the step of applying heating current to a working roller, said working roller being an electrode.

7. A method as defined in claim 6 including the step of cooling said working roller.

8. A method as defined in claim 6 including the step of adjusting separately the speeds of said sheet stock clamped between said dies and of said roller.

9. A method as defined in claim 1 including the step of cooling said dies.

10. A method as defined in claim 1 wherein said dies are comprised of a tungsten-copper alloy containing about 85% tungsten and about 15% copper.

11. A method as defined in claim 1 wherein said sheet stock is comprised of a high-strength metal of a titanium copper alloy alloy or a titanium-aluminum alloy.

12. A method as defined in claim 1 wherein said sheet stock is comprised of a nickel basis alloy comprising 25–60% Ni.

13. A method as defined in claim 1 wherein said sheet stock is comprised of a martensitic steel.

* * * * *